US006776281B2

(12) United States Patent
Ovadia

(10) Patent No.: US 6,776,281 B2
(45) Date of Patent: Aug. 17, 2004

(54) COMBINATION DISPLAY AND STORAGE BOX AND PICTURE FRAME

(76) Inventor: Joseph Ovadia, 109 Long Hill Rd., Little Falls, NJ (US) 07424

( * ) Notice: Subject to any disclaimer, the term of this patent is extended or adjusted under 35 U.S.C. 154(b) by 0 days.

(21) Appl. No.: 09/973,668

(22) Filed: Oct. 9, 2001

(65) Prior Publication Data

US 2003/0066765 A1 Apr. 10, 2003

(51) Int. Cl.[7] ..... B65D 69/00

(52) U.S. Cl. ..... 206/232; 206/6.1; 206/566; 40/725

(58) Field of Search ..... 206/223, 575, 206/578, 6.1, 566, 736, 756, 764; 40/722, 724, 725, 729, 733, 771, 772, 779, 768

(56) References Cited

U.S. PATENT DOCUMENTS 1,579,573 A * 4/1926 Stuckey ..... 40/733
2,590,744 A * 3/1952 Woodbury ..... 40/733
2,616,197 A * 11/1952 Osburn ..... 40/733
3,292,285 A * 12/1966 Kitayama ..... 40/701
3,529,374 A * 9/1970 Spetus ..... 40/730
4,420,084 A * 12/1983 Whelan ..... 206/566
4,653,207 A * 3/1987 Wisniewski ..... 40/733
4,732,269 A * 3/1988 Roy ..... 206/566
4,957,565 A * 9/1990 Lehmussaari et al. ..... 127/68
5,167,085 A * 12/1992 Yang ..... 40/711
5,283,967 A * 2/1994 Abrams ..... 40/779
5,383,293 A * 1/1995 Royal ..... 40/768
5,553,702 A * 9/1996 Walsh ..... 206/38
5,575,094 A * 11/1996 Leake et al. ..... 40/124.09
5,845,425 A * 12/1998 Leake et al. ..... 40/725
5,950,815 A * 9/1999 Yetman-Bellows ..... 206/6.1
6,230,428 B1 * 5/2001 Albin ..... 40/730
6,293,038 B1 * 9/2001 Chang ..... 40/738
6,568,114 B1 * 5/2003 Klukan ..... 40/733

* cited by examiner

*Primary Examiner*—Shian T. Luong
(74) *Attorney, Agent, or Firm*—Richard M. Goldberg

(57) ABSTRACT

The present invention relates to a jewelry box, and more particularly to a jewelry box that may be used as a display and storage case by a retailer, and then converted into a picture frame which holds photographs or pictures by a customer. A storage box is provided having first and second lid sections. Together the lid sections define a case body. The case body has an interior cavity which receives an item of jewelry. A hinge means is oriented along an horizontal axis for pivotably connecting the first and second lid sections for opening and closing the case body. An interior frame border is insertable within the interior cavity of the first lid section so that when the hinge means is oriented along a vertical axis, the interior frame border secures a picture within the first lid section. This provides a retailer user with a functional and elegant device for storing and displaying jewelry, and the end-user with an attractive picture frame which is capable of holding and displaying two wallet-sized photographs or pictures.

14 Claims, 6 Drawing Sheets

COMBINATION DISPLAY AND STORAGE BOX AND PICTURE FRAME

FIELD OF THE INVENTION

The present invention relates to a jewelry box, and more particularly to a jewelry box that may be used as a display and storage case by a retailer, and then converted into a picture frame which holds photographs or pictures by a customer.

BACKGROUND OF THE INVENTION

In today's society, there is a countless amount of jewelry out in the market and ownership of jewelry has become a part of nearly every person's dream. Jewelry plays a large role in customs and images such that, in traditional weddings, the rings play an important role in the ceremony.

Jewelry shops sell and display numerous types of jewelry made by different jewelry makers. Most of the time, jewelry is sold and displayed in a jewelry box. Rings, for example, are common types of jewelry sold today that are displayed and/or packaged in typical jewelry boxes.

The common jewelry box is made up of a base having a jewelry holding pad and a top lid hingedly connected to the base. A single ring or a set of earrings is held in position on the holding pad inside the base for storage or display purposes. The top lid can be oriented into an open position for display purposes. However, once the ring is removed from the box, the box is either discarded or placed in a bureau or display drawer to collect dust.

Accordingly, there is a need for an adaptive jewelry box that may be converted into a picture box or picture frame when its original use for the storage and retail display of a jewelry item has been fulfilled.

SUMMARY OF THE INVENTION

The present invention relates to a displayable jewelry box that, after the jewelry item is removed, may be used as a picture frame.

The box is designed to compliment the needs of the modern day retailer. It reduces the amount of inventory space significantly with its universal size and interchangeable pads. The box holds single/double rings, earrings, pendants, earring and pendant combo, bracelets, watches, bangles: basically any and all types of jewelry sold at retail. Converting it for use with a particular type of jewelry only requires that the user insert the specific pad that is designed to retain the particular jewelry intended for display.

A storage box is provided having first and second lid sections. Together the lid sections define a case body. The case body has an interior cavity which receives an item of jewelry. The first and second lid sections have peripheral edges so that when the case body is in a closed position the peripheral edges are juxtaposed to one another. A hinge means is oriented along an horizontal axis for pivotably connecting the first and second lid sections for opening and closing the case body. An interior frame border is insertable within the interior cavity of the first lid section so that when the hinge means is oriented along a vertical axis, the interior frame border secures a picture within the first lid section.

The storage box can hold two wallet size photos: one inside each of the two lids. The user simply positions the box in its vertical, and open-most, configuration for optimal viewing of the photographs.

It is, therefore, an object of the present invention to have a jewelry box that can be converted for use as a picture frame.

It is another object of the present invention to provide a jewelry box that is suitable for both storage and display purposes.

It is another object of the present invention to provide a jewelry box that is adaptable to store and display a variety of jewelry types with minimum adjustment.

It is another object of the invention to provide a picture frame for a jewelry box upon which a retailer may hot stamp a logo.

It is a further object of the present invention to provide a jewelry box that is suitably attractive as a picture frame.

DETAILED DESCRIPTION OF THE INVENTION

The figures disclose illustrative embodiments of the present invention which serve to exemplify the object.

Figure 1:
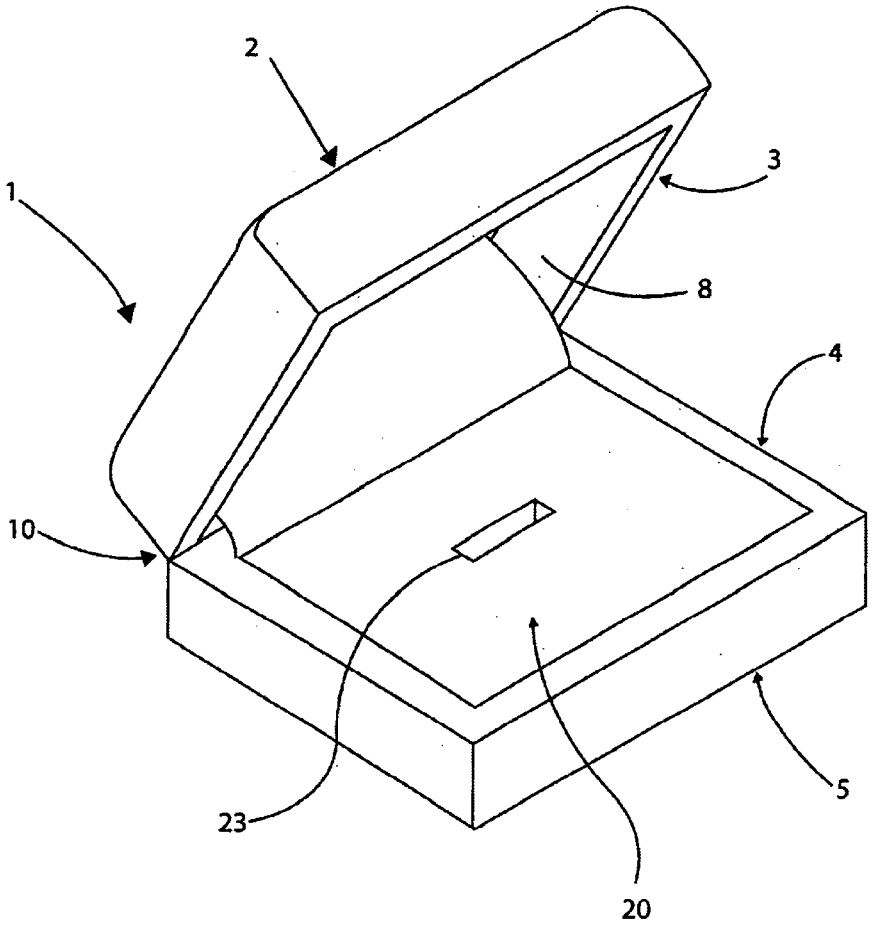
FIG. 1 is a perspective view of the storage box as adapted to hold a ring, according to one embodiment of the present invention.

FIG. 1 demonstrates an embodiment of the present invention configured to hold rings. The storage box 1 has a top lid 2 and a bottom lid 5 that are tray shaped and which are pivotably joined by a hinge 10 that is oriented along a horizontal axis when adapted for this retail use. Peripheral edges 3, 4 define an interior cavity 8 and are juxtaposed when the storage box 1 is in the closed position.

Ring insert element 20 is inserted in the interior cavity 8 of the storage box 1, when it is to be used as a display means for retail purposes. The user merely slides the ring insert element 20 at an angle into the interior cavity 8 and then aligns the ring insert element 20 so as to lay it parallel to the plane of the lid 2, 5. When in place, the ring insert element 20 fully occupies the interior cavity 8 and is frictionally secured by the peripheral edges 3, 4. Ring recess 23 is defined within ring insert element 20 in approximately a central fashion. The ring intended to be displayed by the retailer is held in place by the ring recess 23. Furthermore, the ring recess serves to securely hold the ring in place during transportation and storage.

Figure 2:
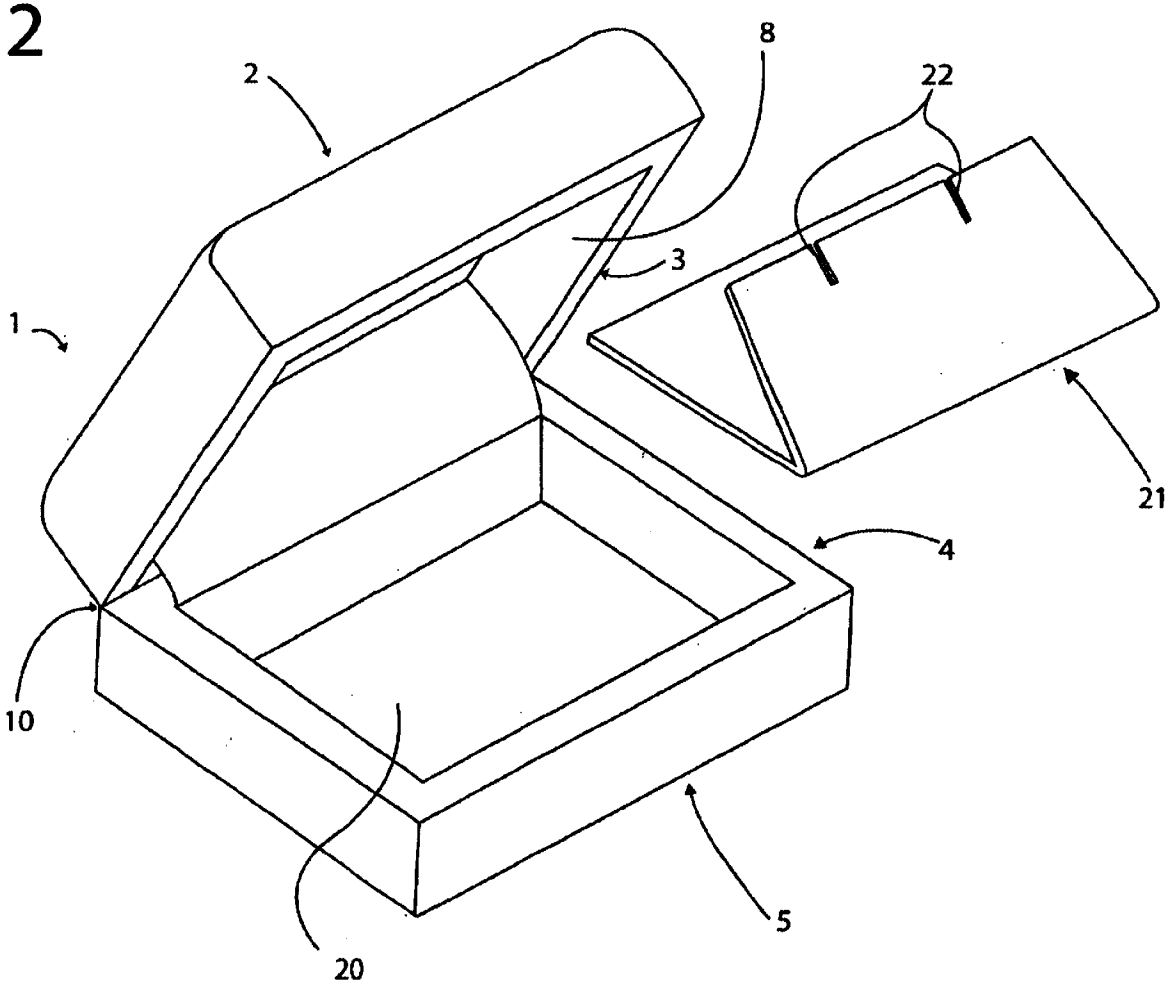
FIG. 2 is an exploded perspective view of the storage box as adapted to hold a pendant, according to one embodiment of the present invention.

FIG. 2 demonstrates an embodiment of the present invention configured to hold a pendant or such type of jewelry. The exploded view demonstrates the pendant insert element 21 as it appears when removed from the storage box 1. A user of the storage box 1 for display purposes would insert the pendant insert element 21 in the interior cavity 8 of the storage box 1 —as described above for the ring insert element 20—then place the jewelry in the slots 22 designed for that use. Although ring insert element 20 and pendant insert element 21 are shown in FIGS. 1 and 2, any insert element that may accommodate bracelets, earrings, bangles, lockets, chains, watches or any other jewelry may be used. The invention is not limited in this respect.

Figure 3:
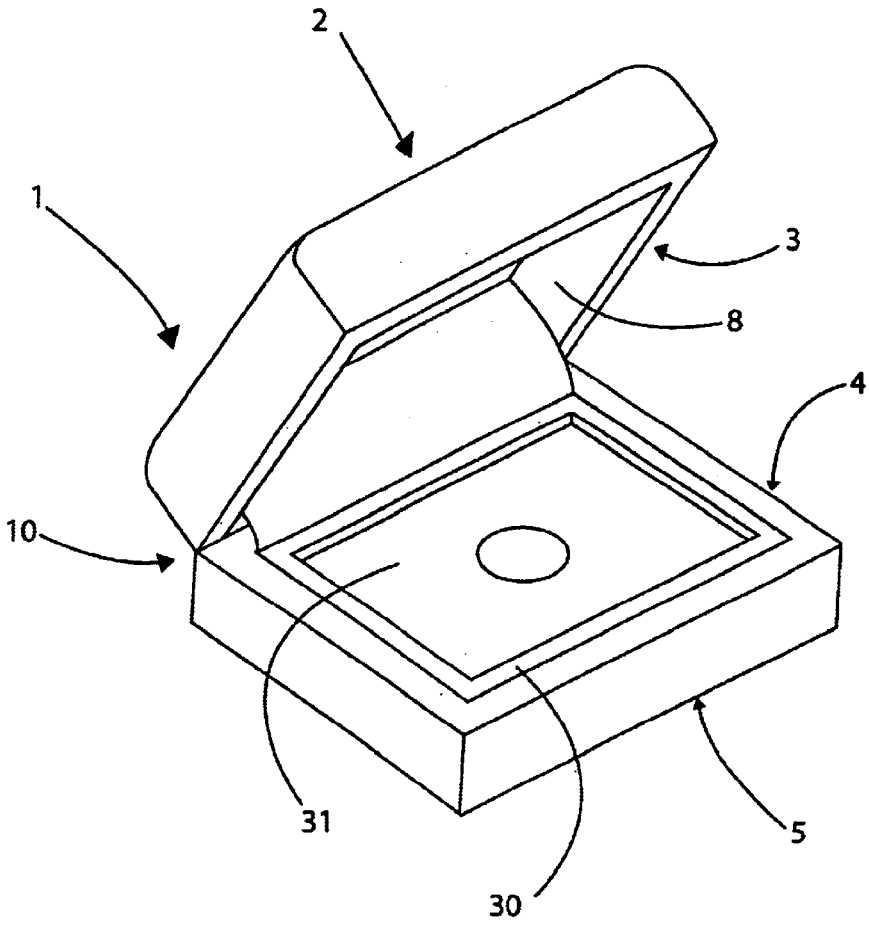
FIG. 3 is a perspective view of the storage box as adapted to hold a riser and frame border.
Figure 4:
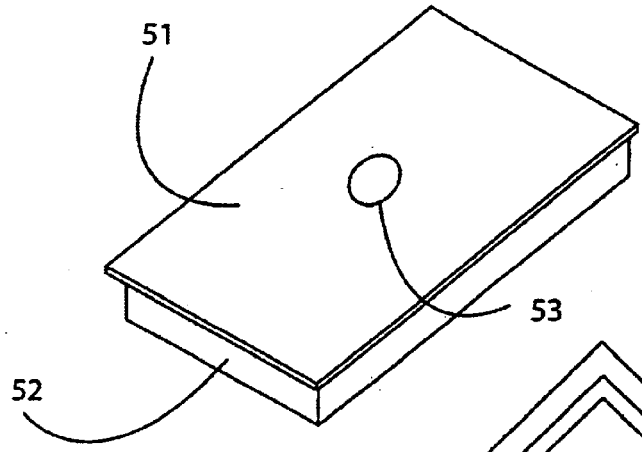
FIG. 4 is a perspective view of the riser element of the storage box, according to one embodiment of the present invention.

As illustrated in FIG. 3, the storage box 1 is adaptable for use as a picture frame. In this transformed state, the storage box 1 has the insert element removed from the interior cavity 8, and therein is sequentially placed a riser 31, a picture or photo 33, a lens 32, and a frame border 30. This may be completed for both top lid 2 and bottom lid 5. As illustrated in FIG. 4, the riser 31, in one embodiment, is composed of a plastic material with a planar surface 51, corresponding in size to the length and width of the interior cavity 8 of the storage box 1, and a flange 52 whose height nearly corresponds to the depth of the interior cavity 8. Centrally in the planar surface 51 is described a hole 53, of sufficient diameter so as to allow for a single finger to be able to grab the riser 31 for manipulation.

After placement of the riser 31 in the interior cavity 8 of the storage box 1, the user lays a wallet sized photo or picture 33 upon the planar surface 51. The planar surface 51 defines the maximum size of the picture or photo 33 for display purposes, and therefore the riser 31 may be used to aid in cropping non-wallet size photos or pictures 33 to the appropriate size.

Figure 7:
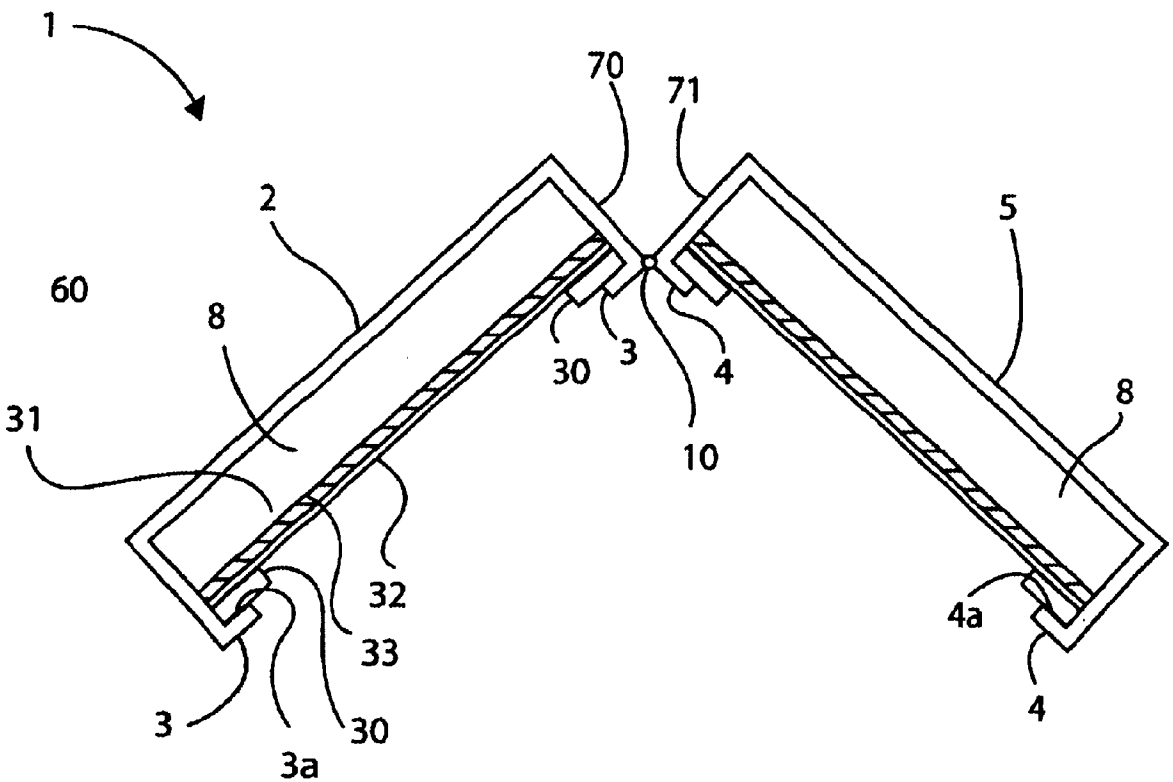
FIG. 7 is a top cutaway view of the storage box when it is adapted for use as a picture frame, according to one embodiment of the present invention.

As shown in FIG. 7, the user may then place a lens 32 which, in various embodiments of the present invention, may be made of glass or plastic, or other suitably transparent and workable materials, on top of the photo or picture 33. The lens 32 shares the same two dimensional characteristics as the planar surface 51 of the riser 31, in that the length and width are coequal to the corresponding dimensions of the interior cavity 8 of the storage box 1. The lens 32 serves as a protective surface to prevent damage to the photo or picture 33 from various elements such as dust, dirt, liquid spills, as well as, normal wear and tear that would otherwise more quickly degrade or destroy the photo or picture 33.

Figure 5:
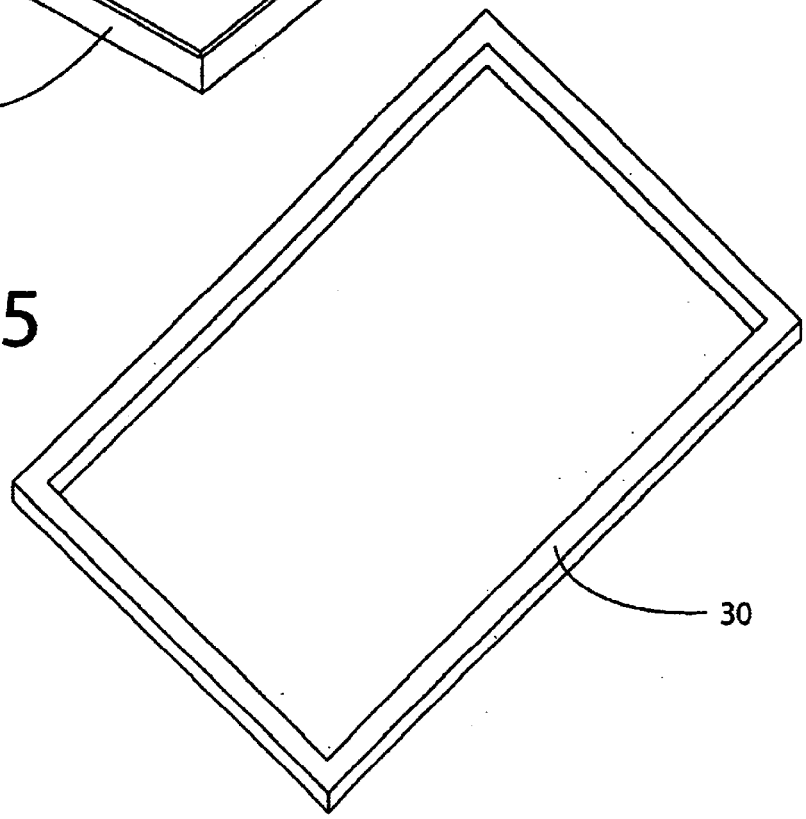
FIG. 5 is a perspective view of the frame border element of the storage box, according to one embodiment of the present invention.

Upon the lens 32 is rested the frame border 30. The frame border 30, which is illustrated in FIG. 5, serves as a decorative touch for completing the transformation of the storage box 1 from a jewelry display and storage device to an attractive picture frame. It further serves as the securing piece for the unit by holding the riser 31, the photo or picture 33, and the lens 32 securely in place by means of its engagement with the peripheral edges 3, 4 of the storage box 1. In one embodiment, this engagement is effected by slipping the edges of the frame border 30 underneath the lips 3*a*, 4*a* of the peripheral edges 3, 4. The frame border 30 may be made out of any suitable material, but preferably of a material that is amenable to metallic plating, so as to, for example, create the effect of a gold finish. Additionally, the material should be also amenable to hot stamping so that a user on the retail end may have the company logo or trademark stamped upon the frame border 30.

Figure 6:
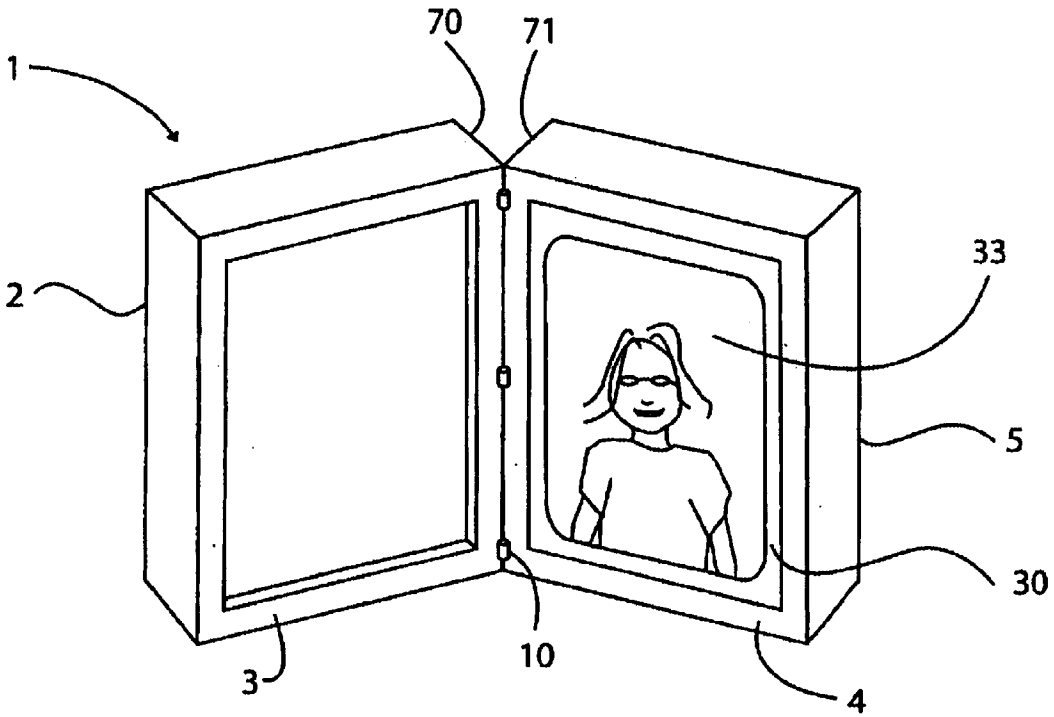
FIG. 6 is a perspective view of the storage box when it is adapted for use as a picture frame, according to one embodiment of the present invention.

When the user has performed the above tasks for converting the storage box 1 into a picture frame, either on a single lid section 2, 5, or as in the preferred embodiment, on both lid sections 2, 5, the storage box 1 is then oriented by the user so that the axis defined by the hinge 10, is in a vertical position, as shown in FIG. 6. This involves simply grasping the storage box 1 when it is in its normal jewelry display position, and rotating the storage box 1 ninety degrees on the axis which is perpendicular to the axis defined by the hinge 10, and coaxial with the axis defined by the user's arm when effecting this motion. The end result of this ninety degree rotation is the hinge 10 being in an upright, vertical position.

The completed picture frame and all of its elements are illustrated in FIG. 7 from a top cutaway view, the riser 31, the lens 32, the photo or picture 33, the frame border 30, and their positioning within the interior cavity 8, as is consistent with use of the storage box I as a picture frame.

As further illustrated in FIG. 6, the storage box 1 is placed in the upright, or vertical, position when used as a picture frame. The two lids 2, 5 of the box which are hingedly attached, are at approximately, in one embodiment of the present invention, a ninety degree angle with respect to each other. According to one embodiment of the present invention, the two edges 70, 71 of the storage box 1 that are hingedly attached are perpendicular when in the openmost position.

What is claimed is:

1. A combination display and storage box and picture frame, comprising:

a base having a first interior cavity defined therein, said base having a peripheral edge;

a lid having a second interior cavity defined therein, said lid having a peripheral edge so that said lid and base together form a case body and said peripheral edges of said base and said lid are juxtaposed when said case body is in a closed position;

a hinge oriented along respective edges of said base and lid for pivotably connecting said base and said lid for opening and closing said case body;

a pad removably insertable within said base for holding an item for display thereon for display and sale when said lid is opened relative to said base and for holding the item for storage when said lid is closed relative to said base; and a hold down arrangement for removably holding a picture within said base so as to display said picture when said pad has been removed, said lid is opened relative to said base and said hinge is oriented along a vertical axis.

2. The combination display and storage box and picture frame according to claim 1, wherein said base and lid each having a backing wall and upstanding peripheral walls in surrounding relation to a periphery of the backing wall.

3. The combination display and storage box and picture frame according to claim 1, wherein said case body is made of wood.

4. The combination display and storage box and picture frame according to claim 1, wherein said frame is plated to produce a gold-like finish.

5. The combination display and storage box and picture frame according to claim 1, further comprising a transparent member insertable within said first interior cavity of said base in overlying relation on said picture, and said hold down arrangement includes an interior frame border for insertion in said first interior cavity to secure said picture and said transparent member within said base.

6. The combination display and storage box and picture frame according to claim 5, wherein said base further comprises a peripheral lip for frictionally engaging said interior frame border within said first interior cavity of said base.

7. The combination display and storage box and picture frame according to claim 6, wherein said lid further comprises a peripheral lip for frictionally engaging an interior frame border within said second interior cavity of said lid.

8. The combination display and storage box and picture frame according to claim 1, further comprising a riser insertable in the base when said pad is removed for elevating said picture relative to a backing wall of said base.

9. The combination display and storage box and picture frame according to claim 1, further comprising a second hold down arrangement for removably holding a second picture within said lid so as to display said second picture when said lid is opened relative to said base and said hinge is oriented along the vertical axis.

10. The combination display and storage box and picture frame according to claim 9, further, comprising a riser for elevating said second picture relative to a backing wall of said lid.

11. The combination display and storage box and picture frame according to claim 10, further comprising a transparent member insertable within said second interior cavity of said lid in overlying relation on said second picture, and said second hold down arrangement includes an interior frame border for insertion in said second interior cavity to secure said second picture and said second transparent member within said lid.

12. A combination display and storage box and picture frame, for storing and displaying an item and for displaying first and second pictures, said combination display and storage box and picture frame comprising:

a base having a first interior cavity defined therein, said base having a peripheral edge;

a lid having a second interior cavity defined therein, said lid having a peripheral edge so that said base and lid together define a case body and said peripheral edges of said base and lid are juxtaposed when said case body is in a closed position;

a hinge oriented along respective edges of said base and lid for pivotably connecting said base and lid for opening and closing said case body;

a pad removably insertable within said base for holding an item for display and sale when said lid is opened relative to said base and for holding the item for storage when said lid is closed relative to said base; and a first riser insertable within said first interior cavity of said base when said pad is removed for elevating the first picture relative to a backing wall of said base;

a second riser insertable within said second interior cavity of said lid for elevating the second picture relative to a backing wall of said lid;

a first interior frame border insertable within said first interior cavity of said base so that when said hinge is oriented along a vertical axis, said first interior frame border secures the first picture within said base; and a second interior frame border insertable within said second interior cavity of said lid so that when said hinge is oriented along the vertical axis, said second interior frame border secures the second picture within said lid.

13. The combination display and storage box and picture frame according to claim 12, wherein said base and lid each further comprise first and second peripheral lips, respectively, for frictionally engaging respective said first and second interior frame borders within said respective first and second interior cavities of said respective base and lid.

14. The combination display and storage box and picture frame according to claim 12 further comprising first and second transparent members insertable within said respective first and second interior cavities of said base and lid and on the first and second pictures.

* * * * *